United States Patent [19]

Ohara et al.

[11] Patent Number: 5,016,543

[45] Date of Patent: May 21, 1991

[54] FREIGHT SYSTEM

[75] Inventors: Osamu Ohara; Hiroshi Kawashima; Hiroshi Takata, all of Iwata, Japan

[73] Assignee: Yamaha Hatsudoki Kabushiki Kaisha, Iwata, Japan

[21] Appl. No.: 385,576

[22] Filed: Jul. 26, 1989

[51] Int. Cl.[5] ..... B60L 15/40

[52] U.S. Cl. ..... 105/150; 105/149; 105/102; 105/133; 105/153; 104/93

[58] Field of Search ..... 104/89, 93, 246, 122, 104/115, 116, 88; 105/148, 150, 152, 30, 153, 96.1, 149, 98, 101, 103, 104, 130, 133, 102; 901/14, 16; 74/665 GE; 192/18 B

[56] References Cited

U.S. PATENT DOCUMENTS

| | | | |
|---|---|---|---|
| 875,864 | 1/1908 | Stout | 104/122 |
| 1,340,962 | 5/1920 | Lane | 104/122 |
| 1,412,831 | 4/1922 | Bennington | 105/152 |
| 3,018,739 | 1/1962 | Carroll | 104/93 |
| 3,129,671 | 4/1964 | Vanderbeck | 104/93 |
| 3,387,689 | 6/1968 | Ovshinsky | 192/18 B |
| 4,423,685 | 1/1984 | Kerckhoff | 104/93 |
| 4,531,460 | 7/1985 | Pamer | 105/150 |
| 4,570,543 | 2/1986 | Ishikura et al. | 104/93 |
| 4,600,358 | 7/1986 | Graf | 901/16 |

FOREIGN PATENT DOCUMENTS

| | | | |
|---|---|---|---|
| 2320777 | 11/1974 | Fed. Rep. of Germany | 104/93 |

*Primary Examiner*—George E. A. Halvosa
*Assistant Examiner*—Mark T. Le
*Attorney, Agent, or Firm*—Ernest A. Beutler

[57] ABSTRACT

Two embodiments of monorail conveyor systems wherein the conveyor is operated by a drive motor that has its center of gravity positioned between the vertical sides of the monorail so as to improve stability and to permit the use of a single friction driven wheel. A gripping device is carried by the conveyor mechanism by a cable system so that it can be raised and lowered through a wide variety of heights.

11 Claims, 5 Drawing Sheets

FREIGHT SYSTEM

BACKGROUND OF THE INVENTION

This invention relates to a freight system and more particularly to an improved article conveying system of the monorail type.

It is well known in many operations such as engine assembly lines to employ a conveying system for automatically conveying parts to predetermined assembly stations. Although a wide variety of conveying systems have been proposed for this purpose, most of these conveyors become quite large and complicated. The monorail type system, wherein the conveyor comprises a monorail and a traveling conveying mechanism that moves along the monorail has a wide variety of applications due to its simplicity. However, this same simplicity gives rise to certain disadvantages. For example, if the monorail runs over areas that extend at different levels, it is necessary for the monorail to climb and descent grades. In order to do this with previously proposed arrangements, complicated gear or other systems have been required in order to permit the monorail to go up and down these grades. In addition, the stability of the monorail type of conveyor, due to its use of a single guide rail, can give rise to problems both when going up and down grades and also when rounding curves.

It is, therefore, a principal object of this invention to provide an improved monorail type of conveying system.

It is another object of this invention to provide a monorail conveying system wherein the travelling conveyor has good stability on the monorail and can traverse a wide variety of paths including ascending and descending grades and rounding curves.

In order to provide maximum space utilization in factories or work areas, it is frequently necessary for the conveyor to travel over different heights. However, often the places where the work pieces are to be deposited and raised bay be at various distances from the guide rail even though the guide rail may have raised and lowered sections. That is, there are times when it is desirable to place the guide rail at different heights relative to the respective work stations. Previously proposed monorail conveyors have not permitted such height variations between the rail and the various locations where the work piece is picked up or deposited due to the limited vertical travel of the gripping device carried by the conveyor, if any vertical travel in fact is provided.

It is, therefore, a still further object of this invention to provide an improved type of conveying apparatus where the traveling conveyor that moves along the guide rail carries a gripping device that is movable vertically relative to the travelling device so as to accommodate different heights between the guide rail and the various work stations.

SUMMARY OF THE INVENTION

A first feature of this invention is adapted to be embodied in a monorail type of conveyor including a guide rail. The conveyor includes a travelling conveyor that is supported for movement along the guide rail. The travelling conveyor is powered by an electrical motor that is positioned so that its center of gravity is disposed substantially in line with the guide rail to increase stability.

Another feature of the invention is adapted to be embodied in a travelling conveyor having guide rail means. Travelling conveyor means are associated with the guide rail means and are driven therealong. In accordance with this feature of the invention, the travelling conveyor means carries a gripping means that is movable through selected vertical distances relative to the travelling conveyor means so as to accommodate the handling of work pieces at stations that are positioned at various heights relative to the guide rail means.

DETAILED DESCRIPTION OF THE PREFERRED EMBODIMENTS

Figure 1:
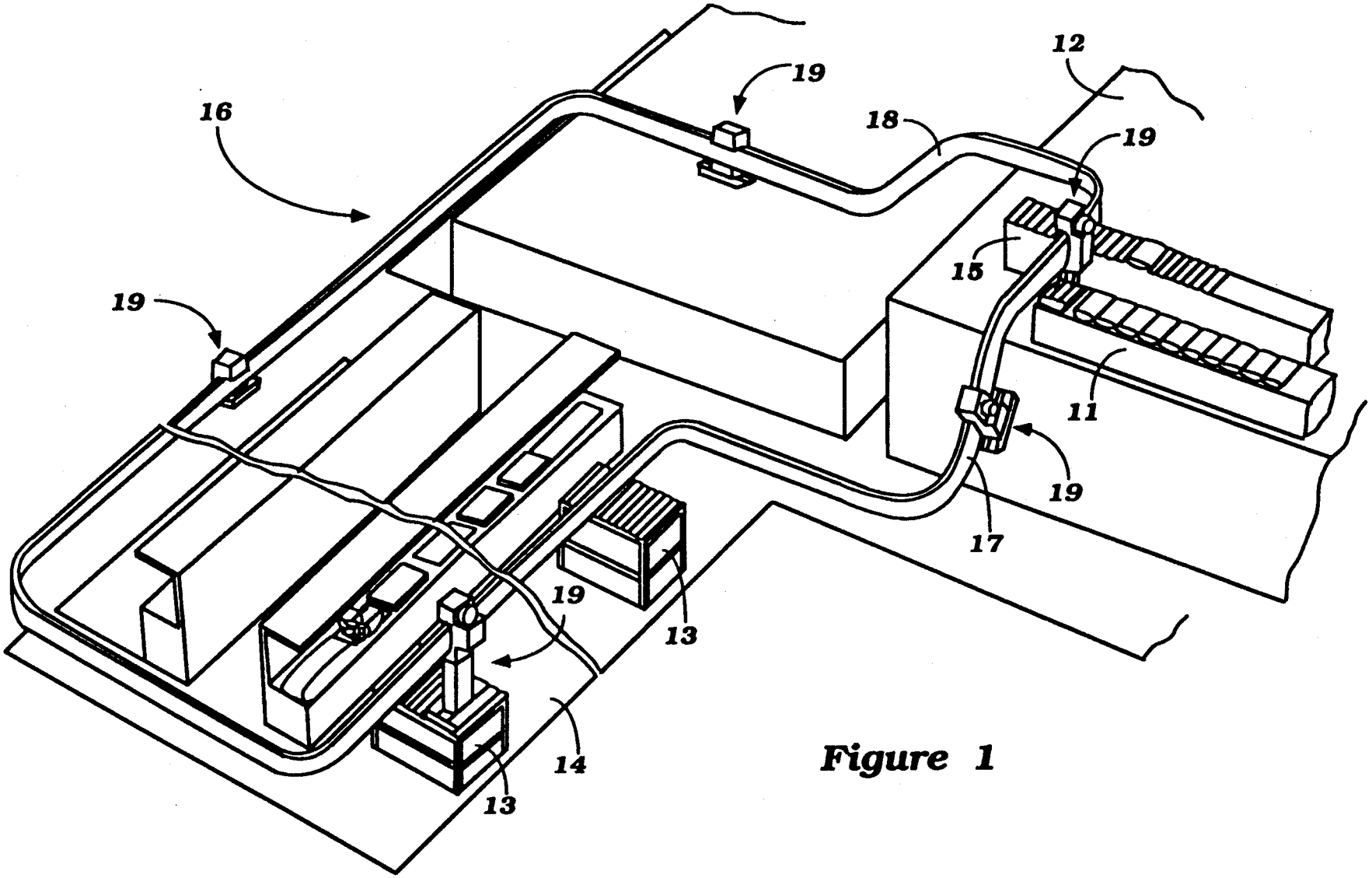
FIG. 1 is a perspective view showing a plant incorporating a conveyor system constructed in accordance with an embodiment of the invention.

Referring first to FIG. 1, there is depicted generally a plant, such as an automotive engine assembly line, having a conveyor system that is constructed in accordance with an embodiment of the invention and which is adapted to deliver work pieces to a delivery conveyor 11 that is positioned in a raised area 12 of the plant and from parts bins 13 positioned at a lower level 14 in the plant. Alternatively, the device may pick up work pieces at a higher area and lower them to a lower work area or may move them between various areas depending upon the particular orientation of the plant. Empty work piece buckets are delivered to a transfer conveyor 15.

Figure 2:
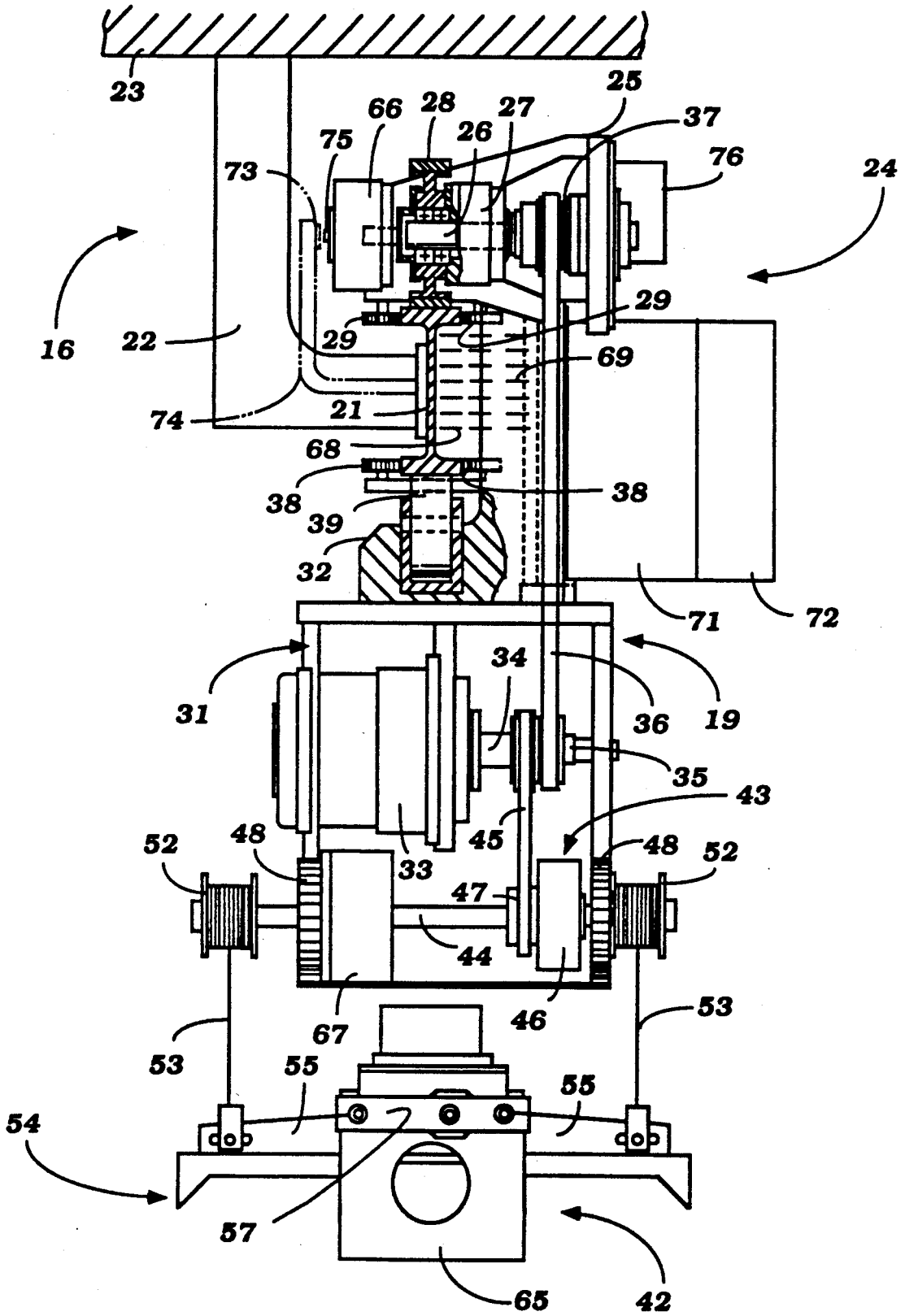
FIG 2 is an enlarged end elevational view of the conveyor mechanism, with a portion broken away and shown in section.
Figure 3:
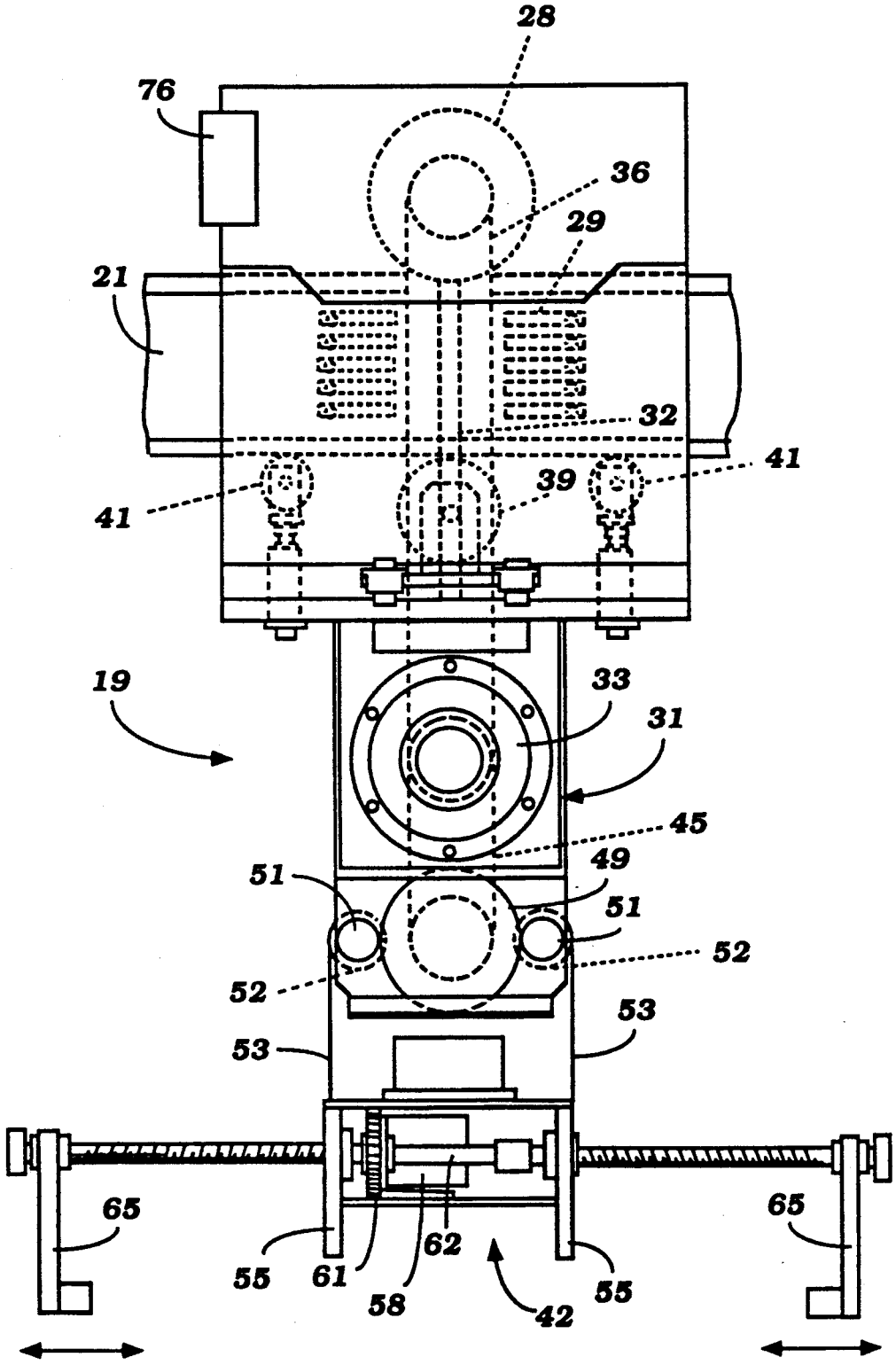
FIG. 3 is a side elevational view thereof.
Figure 4:
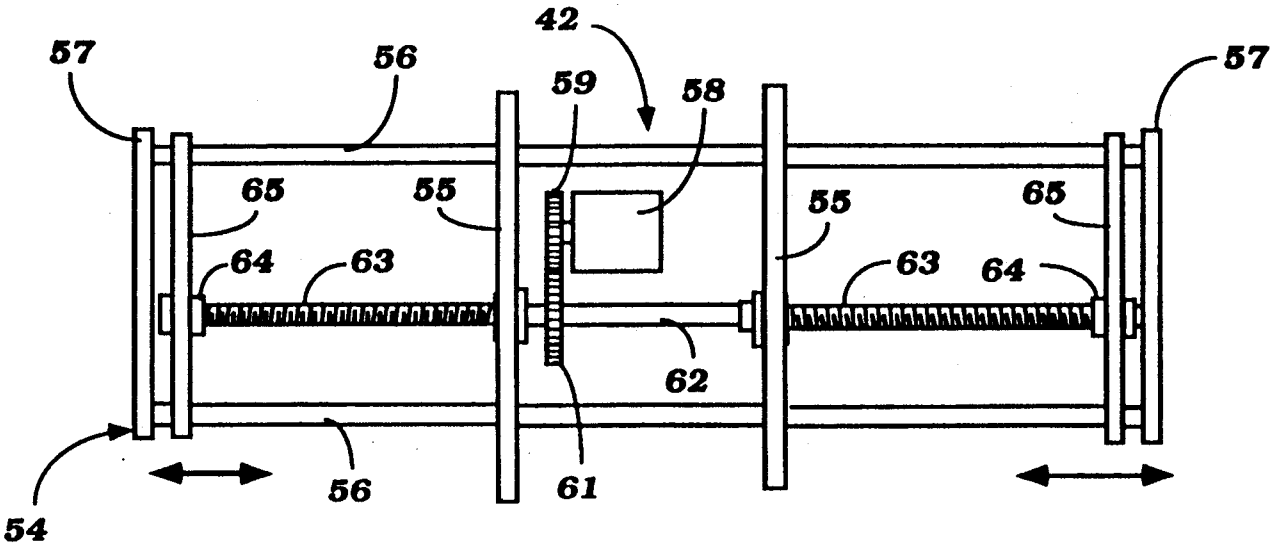
FIG. 4 is a top plan view of the work piece gripping unit.

The conveyor system includes a monorail or guide rail, indicated generally by the reference numeral 16 and having a construction as will be described. The monorail 16 has an ascending portion 17 running to the raised area 12 from the floor 14 and an descending section 18 running in the opposite direction. A plurality of conveyor assemblies 19 are supported along the rail 16 for conveying the work pieces in the desired path and making stops at the appropriate stations. The conveyor mechanisms 19 will be described in most detail by reference to the remaining figures and first particularly to the embodiment shown in FIGS. 2 through 4.

The monorail 16 is comprised primarily of an I beam 21 having a generally vertically extending web and horizontally extending flanges. The I beam 21 is supported by means of a plurality of L shaped brackets 22 from a roof 23. As has been previously noted, the configuration of the guide rail assembly 16 is such that the I beam 21 will have raised and lowered areas and also curved areas. Of course, the invention can be utilized in conjunction with conveyors wherein the rail is all positioned at the same elevation, but the invention has particular utility in conjunction with arrangements wherein the rail has elevating and lowering sections.

The conveyor 19 includes a supporting and driving conveyor, indicated generally by the reference numeral 24 that is comprised of a frame having an upper portion 25 that journals a driving shaft 26 in an appropriate member. The driving shaft 26 is driven in a manner to be described and is adapted to be drivingly coupled by means of an electrically operated clutch 27 to a rubber or other high friction material tired drive wheel 28 that is engaged with the upper surface of the upper flange of the I beam 21. Obviously, as the wheel 28 is rotated, the conveyor 19 will traverse along the path defined by the I beam 21.

There are also provided for lateral stabilization and for tracking a pair of upper guide rollers 29 that are freely journaled on the upper frame 25 and which engage the sides of the top flange of the I beam 21.

A lower frame assembly 31 is suspended from the upper frame assembly 25 by means including at least one L shaped bracket 32. The frame 31 supports a driving motor 33, the center of gravity of which is vertically beneath the I beam 21 for stability. The motor 33 is a high torque, low speed direct driven motor that drives an output shaft 34 on which a drive pulley 35 is supported. A belt 36 transfers drive from the shaft 34 to the shaft 26. For this purpose a driven pulley 37 is affixed to the shaft 26. As previously noted, the electrically operated clutch 27 drivingly couples the shaft 26 to the drive roller 28 when it is desired to move the conveyor along the rail 21.

There are provided a pair of lower guide rollers 38 that are engaged with opposite sides of the lower flanges of the I beam 21 so as to aid in further stability. An idler roller 39 and a pair of spring biased rollers 41 are also engaged with the underside of this lower flange so as to provide the desired degree of engagement of the roller 28 with the upper flange and so as to improve tracking and stability.

A gripping unit, indicated generally by the reference numeral 42 is suspended from the frame assembly 31 and is movable vertically relative to it by means of a combined drive and suspension unit, indicated generally by the reference numeral 43. The unit 43 includes a main driving shaft 44 that is driven from the motor shaft 34 by means of a belt 45. An electric clutch 46 is interposed between a pulley 47 that is directly driven by the belt 45 and the shaft 44 so as to selectively actuate the shaft 44 and raise and lower the gripping unit 42 through substantial height variations in the manner now to be described.

A pair of gears 48 are affixed to the opposite ends of the shaft 44 and are each enmeshed with a pair of diametrically opposed driven gears 51. The gears 51 are affixed to shafts upon which drums 52 are fixed. The drums 52 have wound on them respective lengths of cable 53 that are connected to a frame assembly 54 of the work piece gripping unit 42.

The frame assembly 54 includes a pair of cross bars 55 that are connected to perpendicularly extending plates 56 which are capped at their opposite ends by end plates 57.

An electric motor 58 is carried by the frame assembly 54 and drives a driving gear 59. The driving gear 59 is enmeshed with a driven gear 61 that is fixed to a feed shaft 62. The feed shaft 62 is journaled on the frame assembly by the plates 55 and 57 and has a pair of threaded portions 63 of opposite hand. The threaded portions 63 are received in feed nuts 64 that are affixed to gripping plates 65. Operation of the motor 58, which is a reversible motor, will cause the gripping plates 65 to move toward or away from each other between a spaced position as shown in the figures and a gripping position wherein a work piece may be gripped therebetween.

An electrically operated brake 66 is associated with the drive wheel 28 and selectively locks the conveyor 19 in position on the guide rail 21 at times as will be described. In a like manner, an electric brake 67 is associated with the shaft 44 for locking this shaft and the gripping mechanism 55 in its vertically disposed positions. Electric power for the motors 33 and 58, the electrically operated clutches 27 and 46 and the electrically operated brakes 66 and 67 are provided by a plurality of power rails 68 that are positioned along the web of the I beam 22 and are engaged by wipers 69 carried by the frame assembly 25. These wipers 69 deliver the power to a power box 71 which, in turn, is connected to a control box 72 so as to control the various electrical components.

There is also provided at spaced locations along the guide rail 21 position indicators 73 that are carried by angle brackets 74 and which cooperate with a sensor 75 so as to provide signals to the control device 72 when the conveyor 19 is at certain positions on the guide rail 17, such as at the stations 11, 13 and 15.

The control mechanism 72 may include a preprogrammed control that will provide the desired sequence of operations, a typical one of which will be hereinafter described. It should be understood, however, that those skilled in the art can readily adapt the control sequences to specific applications.

When the conveyor 19 is at a station indicated by the position indicator 73, normally the clutches 27 and 46 will be disengaged and the brakes 66 and 67 engage. If it is desired to raise or lower the work piece, the brake 67 is released and the clutch 46 is engaged while the brake 66 remains engaged. The gripping device 54 may then be raised or lowered to the appropriate position and the motor 58 energized so as to either grip or release a work piece.

After the work piece is released or gripped, the gripping device 42 may be again raised or lowered as desired and then the clutch 46 is released and the brake 67 is engaged so as to lock the gripping device 42 at the desired height.

When the conveyor 19 is ready to be moved to the next station, the brake 66 is released and the clutch 27 is engaged so that the conveyor can move to the next station as determined by the position indicator 73 and sensor 75. Again, the gripping device 42 may be raised or lowered and either grip or release a work piece. It is believed from this description that those skilled in the art will readily understand how the conveyor mechanism described can be utilized for any of a wide variety of purposes and in a wide variety of applications.

There is further provided an obstruction indicator 76 that is carried by the frame 25 of the conveyor and which will sense of an obstacle is positioned in front of the conveyor 19 and this will effect operation of the brakes 66 and 67 and release of the clutches 27 and 46 until the obstacle has been cleared.

Figure 5:
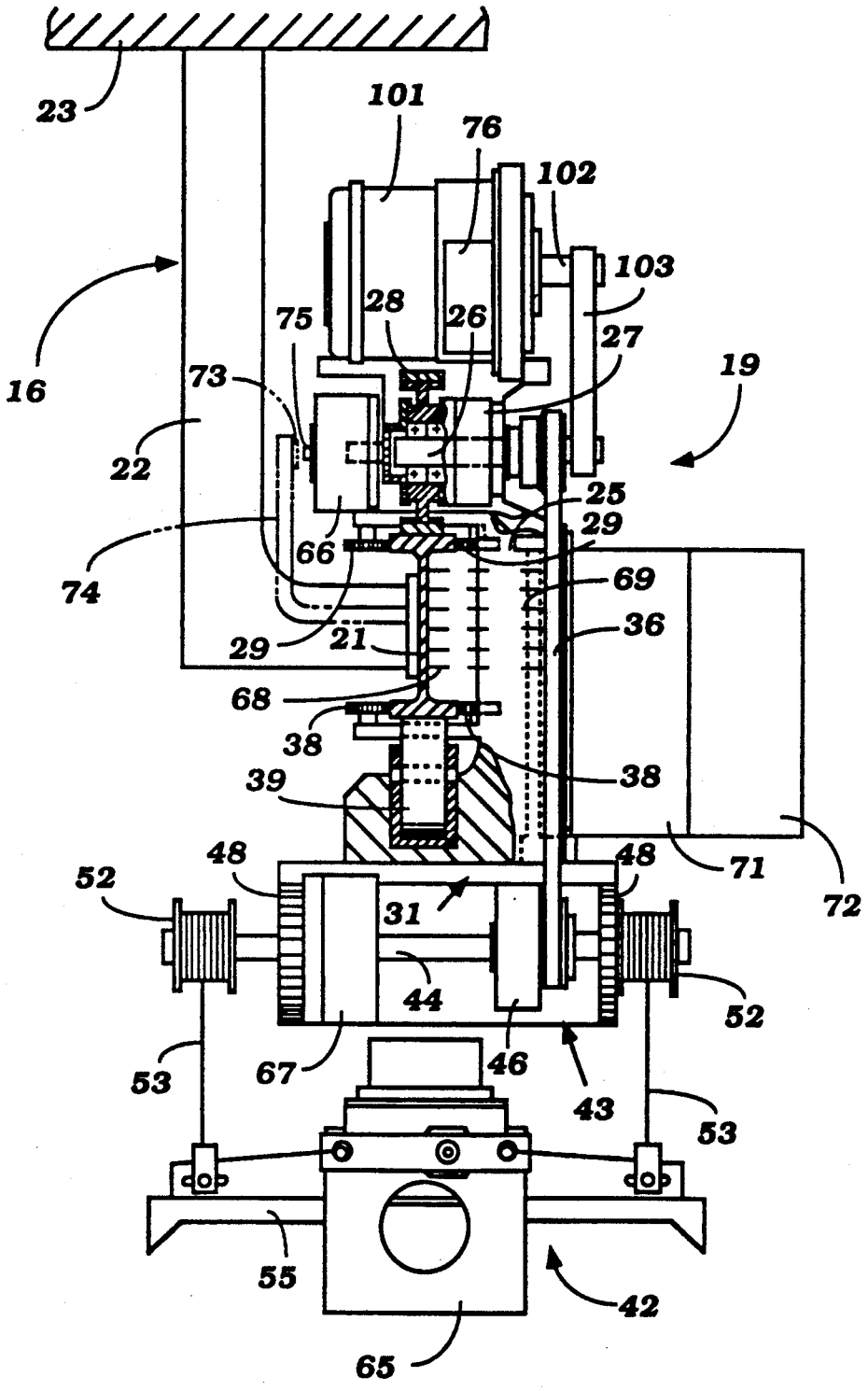
FIG. 5 is an elevational view, in part similar to FIG. 3 and shows another embodiment of the invention.

FIG. 5 shows another embodiment of the invention which is generally similar to the embodiment of FIG. 1 through 4. In this embodiment, however, the main drive motor for driving the conveyor 19 along the rail 21 is supported above the rail rather than below it. As with the earlier embodiment, the center of gravity of the drive motor is located vertically within the area of the rail 21 for stability. As may be seen in FIG. 5, the drive motor 101 is supported on the upper frame 25 and has its output shaft 102 coupled to the shaft 26 by means of a drive belt 103. In all other regards this embodiment is the same as the previously described embodiment and, for that reason, components which are the same as those of the previously described embodiment have been identified by the same reference numerals and further description of them is believed to be unnecessary to understand the construction and operation of this embodiment.

It should be readily apparent from the foregoing description that the described conveyor mechanism permits the use of a monorail assembly with great stability due to the positioning of the drive motor so that is center of gravity is positioned vertically within the outer periphery of the guide rail. In addition, the way in which the gripper mechanism is supported from the conveying mechanism is particularly useful in accommodating a wide variety of height differences and differences in the point at which work pieces can be picked up an released. Although two embodiments of the invention have been illustrated and described, various changes and modifications may be made without departing from the spirit and scope of the invention, as defined by the appended claims.

We claim:

1. A monorail type conveying system comprising a single I beam guide rail, a combined drive and supporting mechanism carried by said guide rail, a drive and support wheel engaging the upper flange of said I beam guide rail for supporting said mechanism upon the upper surface above the web thereof, and an electric motor disposed adjacent one of the flanges of said I beam guide rail, first selectively engageable transmission means for driving said drive and supporting wheel along said guide rail, gripping means carried by said supporting mechanism, and second selectively engageable transmission means for effecting vertical movement of said gripping means relative to said guide rail between a wide variety of heights from said electric motor, at least one of said selectively engageable transmission means being disposed at one side of said I beam guide rail, said electric motor means having a drive shaft, said drive and supporting wheel being rotatable about a shaft, and said means for effecting vertical movement of said gripping means further including a shaft, each of said shafts extending transversely to said I beam guide rail both of said first and second selectively engageable transmission means being driven by said electric motor said electric motor being positioned with its center of gravity vertically between the sides of the guide rail for stability.

2. A monorail type conveying system as set forth in claim 1 wherein the electric motor is positioned above the guide rail.

3. A monorail type conveying system as set forth in claim 1 wherein the electric motor is positioned beneath the guide rail.

4. A monorail type conveying system as set forth in claim 1 wherein the drive and supporting wheel comprises a frictional drive wheel and further including a pair of tracking rollers engaged with the upper sides of the guide rail.

5. A monorail type conveying system as set forth in claim 4 wherein the tracking rollers are engaged with the sides of a flange of the I beam.

6. A monorail type conveying system as set forth in claim 5 wherein there are two pairs of tracking rollers, one of said two pairs associated with the upper flange of the I beam and the other of said two pairs associated with the lower flange of the I beam.

7. A monorail type conveying system as set forth in claim 1 wherein the gripping means is supported for movement relative to the combined drive and supporting mechanism by means of flexible cables.

8. A monorail type conveying system as set forth in claim 1 wherein one of the first and second selectively engageable transmission means includes a selectively engageable clutch.

9. A monorail type conveying system as set forth in claim 1 wherein both of the first and second selectively engageable transmission means includes selectively engageable clutches.

10. A monorail type conveying system as set forth in claim 8 further including a brake associated with one of the first and second engageable transmission means for braking an element driven thereby when the selectively engageable clutch is released.

11. A monorail type conveying system as set forth in claim 9 wherein a brake is associated with each of the selectively engageable clutches for braking an element driven thereby when the associated clutch is disengaged.

* * * * *